US010488790B2

(12) United States Patent
Ishikawa

(10) Patent No.: US 10,488,790 B2
(45) Date of Patent: Nov. 26, 2019

(54) IMAGE FORMING APPARATUS HAVING TRANSFER VOLTAGE CONTROL

(71) Applicant: CANON KABUSHIKI KAISHA, Tokyo (JP)

(72) Inventor: Shimpei Ishikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/198,608

(22) Filed: Nov. 21, 2018

(65) Prior Publication Data

US 2019/0163099 A1 May 30, 2019

(30) Foreign Application Priority Data

Nov. 29, 2017 (JP) ..... 2017-229299
Oct. 22, 2018 (JP) ..... 2018-198358

(51) Int. Cl.
*G03G 15/16* (2006.01)

(52) U.S. Cl.
CPC ..... *G03G 15/1675* (2013.01)

(58) Field of Classification Search
CPC ..... G03G 15/0283; G03G 15/1675; G03G 2215/021; G03G 2215/1614
USPC ..... 399/50, 66, 176, 314
See application file for complete search history.

(56) References Cited

U.S. PATENT DOCUMENTS 5,034,777 A * 7/1991 Ohzeki ..... G03G 15/1675 399/176
2016/0124355 A1* 5/2016 Nishikawa ..... G03G 15/1665 399/66
2016/0202641 A1* 7/2016 Kojima ..... G03G 15/1605 399/66
2019/0049883 A1* 2/2019 Kubota ..... G03G 15/5004

FOREIGN PATENT DOCUMENTS

JP 5-6112 A 1/1993
JP 2008-70808 A 3/2008
JP 2010-250096 A 11/2010
JP 2014164193 A * 9/2014
JP 2017032778 A * 2/2017 ..... G03G 15/0266

* cited by examiner

*Primary Examiner* — Robert B Beatty
(74) *Attorney, Agent, or Firm* — Canon U.S.A. Inc., IP Division

(57) ABSTRACT

A control unit can execute regulation control referred to as active transfer voltage control (ATVC) for setting a transfer voltage output from a second voltage unit to a transfer member so as to transfer a toner image from a photosensitive member to a transfer material based on an electric current value detected by a detection unit and a voltage value output from a voltage output unit. When changing a voltage value output from the voltage output unit during execution of the ATVC, the control unit interrupts execution of a predetermined operation of the ATVC in a predetermined time period including a point of time including when the voltage output from the voltage output unit is changed.

19 Claims, 9 Drawing Sheets

IMAGE FORMING APPARATUS HAVING TRANSFER VOLTAGE CONTROL

BACKGROUND OF THE INVENTION

Field of the Invention

The present disclosure generally relates to an image forming apparatus using an electrophotographic method such as a copying machine and a printer.

Description of the Related Art

Image forming apparatuses using the electrophotographic method include drum type photosensitive members (hereinbelow, referred to as photosensitive drums), charging members for charging the photosensitive drums, exposure units for exposing the charged photosensitive drums to light to form electrostatic latent images thereon, and developing units for developing the electrostatic latent images. The electrostatic latent images formed on the photosensitive drums are developed by toner stored in the developing units, and thus toner images are formed on the photosensitive drums. Further, voltage units output voltages to transfer members arranged to face the photosensitive drums, and thus the toner images borne by the photosensitive drums are electrostatically transferred to transfer materials such as paper and overhead projector (OHP) sheets.

Japanese Patent Application Laid-Open No. 5-6112 describes a configuration in which a voltage (hereinbelow, referred to as a transfer voltage) output to a transfer member to transfer a toner image from a photosensitive drum to the transfer material is set by active transfer voltage control (ATVC). According to Japanese Patent Application Laid-Open No. 5-6112, the transfer voltage is set by the ATVC based on the voltage output to the transfer member and an electric current flowing through the transfer member at the time of a pre-rotation process before transfer of a toner image is started at a transfer portion at which the transfer member abuts on the photosensitive drum.

Recently, miniaturization of image forming apparatuses has gained attention, and Japanese Patent Application Laid-Open No. 2010-250096 describes a configuration in which a voltage unit is used in common to output a voltage to a charging member and to a transfer member. More specifically, a configuration of an image forming apparatus is described which includes a voltage unit for outputting a voltage having a negative polarity to the charging member and the transfer member, a voltage unit for outputting a voltage having a positive polarity to the transfer member, and a detection circuit for detecting an electric current flowing through the transfer member.

However, in the case that the voltage unit is used in common to output a voltage to the charging member and to the transfer member, when the voltage output to the charging member is changed during execution of the ATVC, the voltage output to the transfer voltage is also changed, and an electric current value detected by the detection circuit may fluctuate. Accordingly, it becomes difficult to appropriately set the transfer voltage, and transfer failure may occur in the transfer portion.

In order to suppress occurrence of such transfer failure, a configuration can be considered in which the ATVC is executed again after the voltage output to the charging member is changed. However, in this case, re-execution of the ATVC elongates a first print out time (FPOT) which is a time from when a user issues a print instruction to when an image forming operation is completed.

SUMMARY OF THE INVENTION

The present disclosure generally relates to an image forming apparatus using an electrophotographic method and is more specifically directed to suppression of transfer failure while shortening FPOT as much as possible when a voltage output to a charging member is changed during execution of ATVC in a configuration in which a voltage unit is used in common to output a voltage to the charging member and to a transfer member.

According to an aspect of the present disclosure, an image forming apparatus includes a photosensitive member configured to bear a toner image, a charging member configured to charge the photosensitive member, a transfer member configured to form a transfer portion by abutting on the photosensitive member and to transfer the toner image borne by the photosensitive member to a transfer material at the transfer portion, a first voltage unit configured to output a voltage having a predetermined polarity to the charging member and the transfer member, a second voltage unit configured to be electrically connected to the first voltage unit and to output a voltage having an opposite polarity to that of the predetermined polarity output to the transfer member, a detection unit configured to detect an electric current flowing through the transfer member, and a control unit configured to control the first voltage unit and the second voltage unit, wherein the control unit applies the voltage having the predetermined polarity to the charging member, applies a voltage obtained by superimposing the voltage having the predetermined polarity on the voltage having the opposite polarity to the transfer member, and performs regulation control to set a transfer voltage to be output from the second voltage unit to the transfer member to transfer a toner image from the photosensitive member to a transfer material based on an electric current value detected by the detection unit and a voltage value output from the second voltage unit by causing the first voltage unit and the second voltage unit to respectively output voltages in a state in which a transfer material is not nipped by the transfer portion, and wherein, in a case where the control unit changes a voltage value output from the first voltage unit while performing the regulation control, the control unit does not reflect a detection result detected by the detection unit to the regulation control during a predetermined time period including a point of time when the voltage output from the first voltage unit is changed.

Further features of the present disclosure will become apparent from the following description of exemplary embodiments with reference to the attached drawings.

DESCRIPTION OF THE EMBODIMENTS

Various exemplary embodiments of the present disclosure will be described in detail below with reference to the attached drawings. However, dimensions, materials, and shapes of components and their relative arrangement described in the exemplary embodiments are to be appropriately changed depending on configurations and various conditions of apparatuses to which the present disclosure is applied. Thus, if not specifically mentioned, the scope of the present disclosure is not limited only to such dimensions, materials, shapes and relative arrangement.

[Configuration of Image Forming Apparatus]

Figure 1:
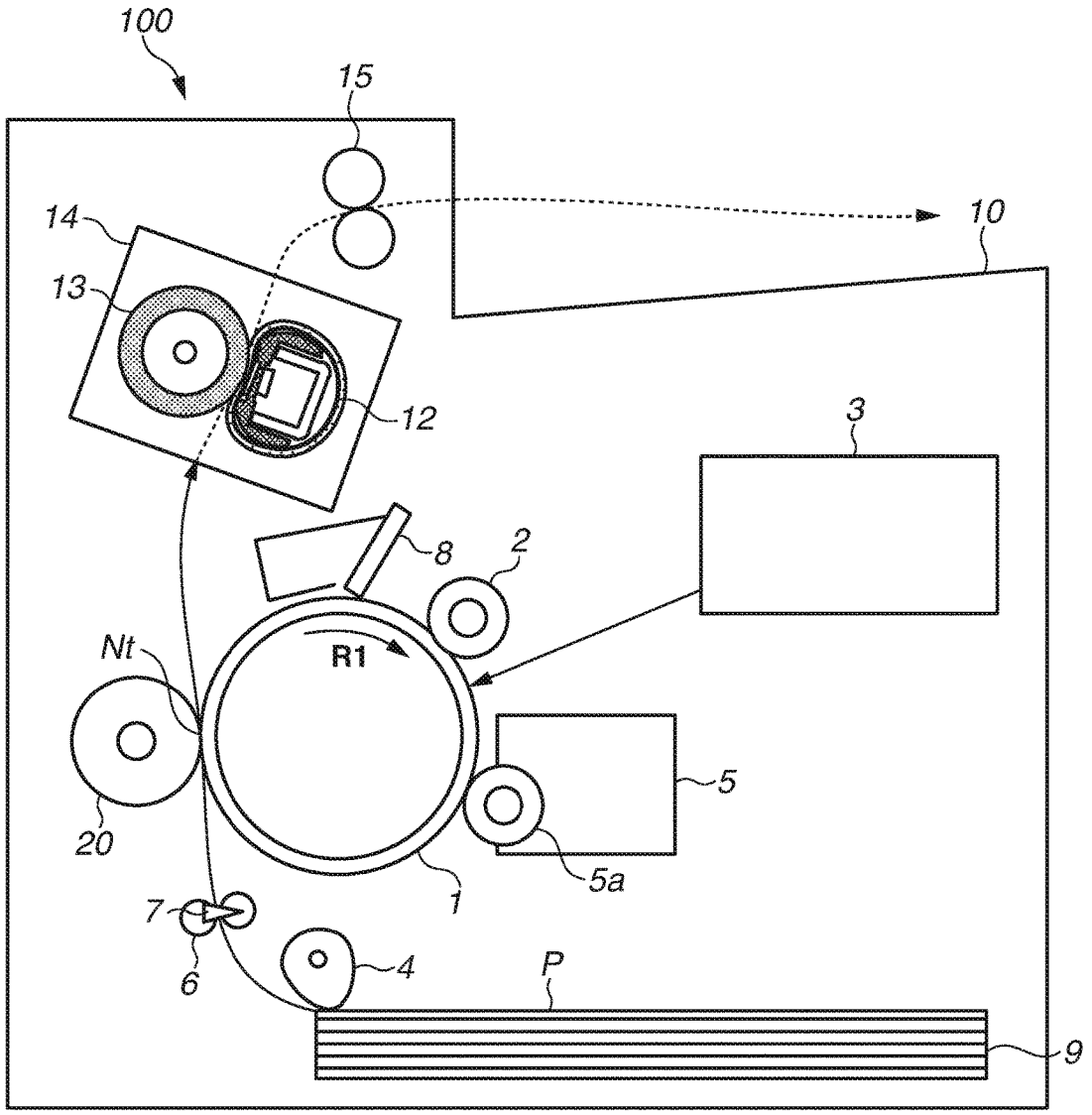
FIG. 1 is a cross-sectional view of a configuration of an image forming apparatus according to a first exemplary embodiment.
Figure 2:
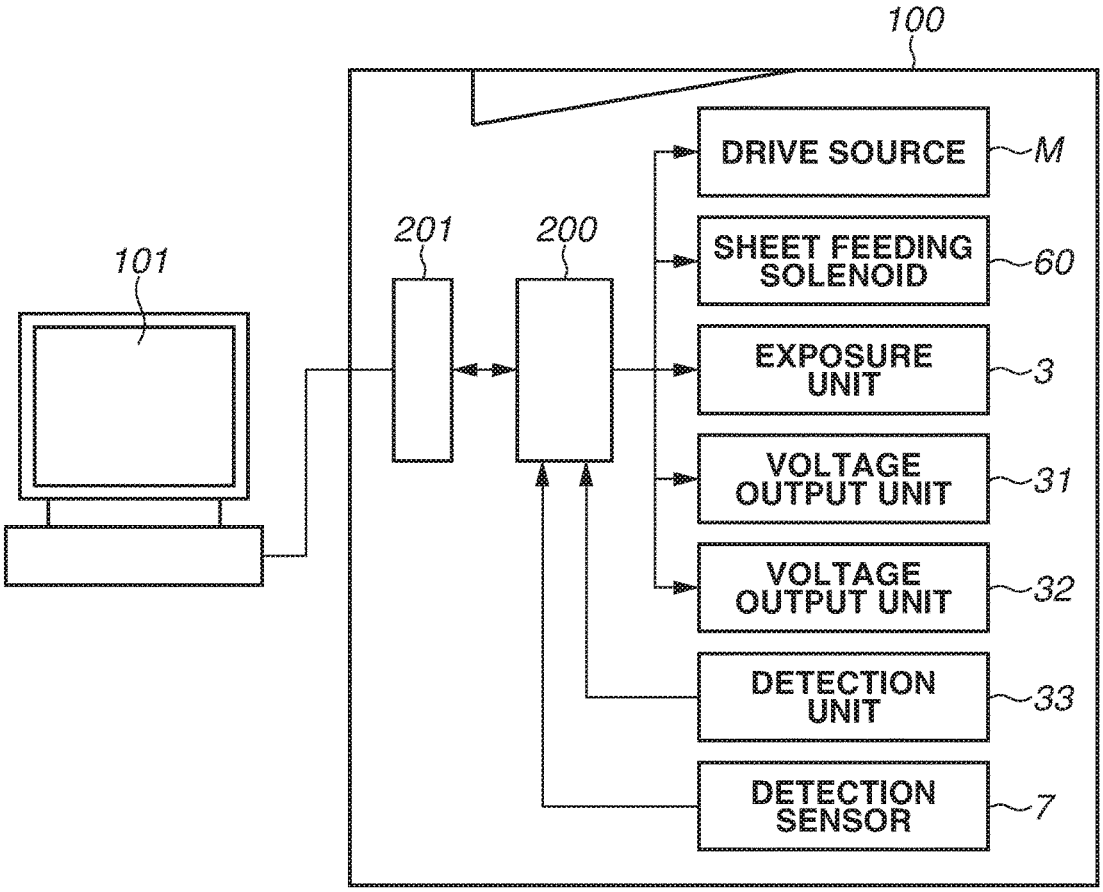
FIG. 2 is a block diagram according to the first exemplary embodiment.

FIG. 1 is a schematic cross-sectional view illustrating a configuration of an image forming apparatus 100 according to a first exemplary embodiment. FIG. 2 is a block diagram according to the present exemplary embodiment. As illustrated in FIG. 2, the image forming apparatus 100 is connected to a personal computer 101 as a host device. An operation start instruction and an image signal from the personal computer 101 are transmitted to a control unit 200 built in the image forming apparatus 100 via an image controller 201.

The image signal from the personal computer 101 is converted into video data by the image controller 201 and then notified to the control unit 200. The control unit 200 controls various units, and thus, image forming is executed in the image forming apparatus 100. The image controller 201 can notify the control unit 200 of conveyance speed information and image quality setting information of a transfer material P from a type of the transfer material P specified by a user and information of the image signal from the personal computer 101 before conveyance of the transfer material P is started. Further, the image controller 201 can display inside information of the control unit 200 on a display unit, not illustrated, and the like.

As illustrated in FIG. 1, the image forming apparatus 100 according to the present exemplary embodiment includes a photosensitive drum 1 which is a drum type photosensitive member, and the photosensitive drum 1 receives a driving force from a drive source M (illustrated in FIG. 2) and is driven and rotated in an arrow R1 direction shown in the drawing at a predetermined peripheral speed. A charge roller 2 as a charging member, an exposure unit 3 for irradiating the photosensitive drum 1 with a laser beam, a developing unit 5 including a developing roller 5*a* as a developing member, and a cleaning unit 8 for collecting toner remaining on the photosensitive drum 1 are arranged around the photosensitive drum 1.

The cleaning unit 8 includes a cleaning blade abutting on the photosensitive drum 1 and a waste toner box for storing the toner collected from the photosensitive drum 1 by the cleaning blade. The developing unit 5 stores toner, and the developing roller 5*a* can bear the toner stored in the developing unit 5 by being applied with a voltage having a polarity opposite to a normal charge polarity of the toner from a developing power source not illustrated. A transfer roller 20 as a transfer member for forming a transfer portion Nt by abutting on the photosensitive drum 1 is arranged on a position facing the photosensitive drum 1.

A voltage output unit 31 (a first voltage unit) illustrated in FIG. 2 outputs a voltage having a predetermined polarity to the charge roller 2 and the transfer roller 20. The predetermined polarity is a polarity same as a normal charge polarity of the toner (a negative polarity according to the present exemplary embodiment). According to the present exemplary embodiment, the voltage output unit 31 outputs a voltage having a negative polarity, and thus the charge roller 2 uniformly charges the photosensitive drum 1. Further, the voltage output unit 31 outputs the voltage having the negative polarity to the transfer roller 20, and thus an electric field is formed in the transfer portion Nt in which toner having a negative polarity moves from the transfer roller 20 to the photosensitive drum 1. In the configuration according to the present exemplary embodiment, the voltage output unit 31 functions as a voltage output unit which is used in common to apply the voltage having the negative polarity to the charge roller 2 and to the transfer roller 20. The configuration can achieve miniaturization and cost reduction of the image forming apparatus 100.

The image forming apparatus 100 according to the present exemplary embodiment executes various types of control at timings except the time of image forming in which a toner image is transferred from the photosensitive drum 1 to the transfer material P at the transfer portion Nt. For example, in order to suppress wearing of the cleaning blade abutting on the photosensitive drum 1, the image forming apparatus 100 performs a supply operation for supplying the toner having the negative polarity from the developing unit 5 to the cleaning blade via the photosensitive drum 1. Further, for example, when a conveyance timing of the transfer material P to the transfer portion Nt is deviated, the image forming apparatus 100 performs a collection operation for electrostatically moving the toner having the negative polarity transferred from the photosensitive drum 1 to the transfer roller 20 to the photosensitive drum 1 and then collecting the toner by the cleaning unit 8. The collection operation is performed at a predetermined timing when it is determined that the toner having the negative polarity adheres to the transfer roller 20. When the above-described supply operation and collection operation are to be executed, the voltage output unit 31 outputs the voltage having the negative polarity to the transfer roller 20.

A voltage output unit 32 (a second voltage unit) illustrated in FIG. 2 outputs a voltage having a polarity opposite to the predetermined polarity (a positive polarity according to the present exemplary embodiment) to the transfer roller 20. The voltage output unit 32 outputs a voltage having a positive polarity to the transfer roller 20, and thus the toner image borne by the photosensitive drum 1 can be transferred to the transfer material P at the transfer portion Nt. In the following descriptions, a voltage formed at the transfer portion Nt for transferring a toner image from the photosensitive drum 1 to the transfer material P is referred to as a transfer voltage.

A fixing unit 14 including a pressing roller 13 as a pressing member and a heating member 12, a discharge roller 15, and a sheet discharge tray 10 as a stacking unit are disposed on a downstream side of the transfer portion Nt in a conveyance direction of the transfer material P. The discharge roller 15 discharges the transfer material P passing through the fixing unit 14 from the image forming apparatus 100, and the sheet discharge tray 10 stacks the transfer material P discharged by the discharge roller 15 therein.

A sheet feeding cassette 9 as a storage unit for storing the transfer material P such as paper and an OHP sheet, a conveyance roller 6, a feeding roller 4 as a feeding unit, and a detection sensor 7 as a detection portion are disposed on an upstream side of the transfer portion Nt in the conveyance direction of the transfer material P. The conveyance roller 6 is a conveyance unit for conveying the transfer material P from the sheet feeding cassette 9 to the transfer portion Nt. The feeding roller 4 feeds the transfer material P stored in the sheet feeding cassette 9 to the transfer portion Nt. The detection sensor 7 is disposed between the transfer portion Nt and the feeding roller 4 in the conveyance direction of the transfer material P and can detect a leading edge and a trailing edge of the transfer material P fed by the feeding roller 4.

Next, an image forming operation according to the present exemplary embodiment is described with reference to FIG. 1. When the control unit 200 receives an operation start instruction from the personal computer 101, the photosensitive drum 1 is driven and rotated in the arrow R1 direction shown in FIG. 1. At that time, the charge roller 2, the developing roller 5*a*, the transfer roller 20, the pressing roller 13, the conveyance roller 6, and the discharge roller 15 are also driven and rotated by receiving a driving force. The photosensitive drum 1 is uniformly charged to a predetermined potential of the negative polarity by the charge roller 2 in a rotation process.

After a surface potential of the photosensitive drum 1 is stabilized, regulation control for setting a voltage (hereinbelow, referred to as a transfer voltage) to be output to the transfer roller 20 to transfer the toner image from the photosensitive drum 1 to the transfer material P is performed in the transfer portion Nt. According to the present exemplary embodiment, a transfer voltage is set by the regulation control referred to as active transfer voltage control (ATVC), and the ATVC is described in detail below.

The image forming apparatus 100 according to the present exemplary embodiment can start driving of various units and execute the ATVC (hereinbelow, referred to as pre-start) while the image controller 201 converts an image signal from the personal computer 101 into video data. The control unit 200 executes the pre-start upon receiving an operation start instruction from the personal computer 101, and thus a time from completion of the ATVC to starting an image forming operation can be shortened compared to a case when the ATVC is executed after completing conversion of the image signal.

When the image controller 201 completes conversion of the image signal and setting of the transfer voltage by the ATVC, the feeding roller 4 rotates for one round by driving of a sheet feeding solenoid 60 (illustrated in FIG. 2) and conveys the transfer material P to the conveyance roller 6. When the detection sensor 7 detects the leading edge of the transfer material P, the exposure unit 3 irradiates the photosensitive drum 1 with the laser beam, and thus the photosensitive drum 1 is subjected to exposure corresponding to the image signal in the rotation process. Accordingly, an electrostatic latent image corresponding to a target image is formed on a surface of the photosensitive drum 1, and the electrostatic latent image formed on the photosensitive drum 1 is developed at a development position at which the developing roller 5*a* bearing the toner abuts on the photosensitive drum 1 and visualized as a toner image on the photosensitive drum 1.

According to the present exemplary embodiment, the normal charge polarity of the toner stored in the developing unit 5 is the negative polarity, and the electrostatic latent image is reversely developed by the toner charged to the same polarity as the charge polarity of the photosensitive drum 1 by the charging roller 2. However, the configuration is not limited to the above-described one, and an electrostatic latent image may be reversely developed using toner of which a normal charge polarity is a positive polarity.

The toner image borne by the photosensitive drum 1 reaches the transfer portion Nt along with the rotation of the photosensitive drum 1 and is transferred to the transfer material P at the transfer portion Nt. At that time, the transfer voltage set by the ATVC is output from the voltage output unit 32 to the transfer roller 20 by the control of the control unit 200. The toner remaining on the photosensitive drum 1 after passing through the transfer portion Nt reaches a position at which the cleaning unit 8 abuts on the photosensitive drum 1 along with the rotation of the photosensitive drum 1 and is collected by the cleaning unit 8.

The transfer material P on which the toner image is transferred at the transfer portion Nt is conveyed to the fixing unit 14, heated and pressed by the heating member 12 and the pressing roller 13 in the fixing unit 14, and thus the toner image is fixed to the transfer material P. The transfer material P on which the toner image is fixed by the fixing unit 14 is then discharged to the sheet discharge tray 10 by the discharge rollers 15. Thus, an image is formed on a transfer material P by the above-described operations in the image forming apparatus 100 according to the present exemplary embodiment.

[Transfer Voltage Setting by ATVC]

Figure 3:
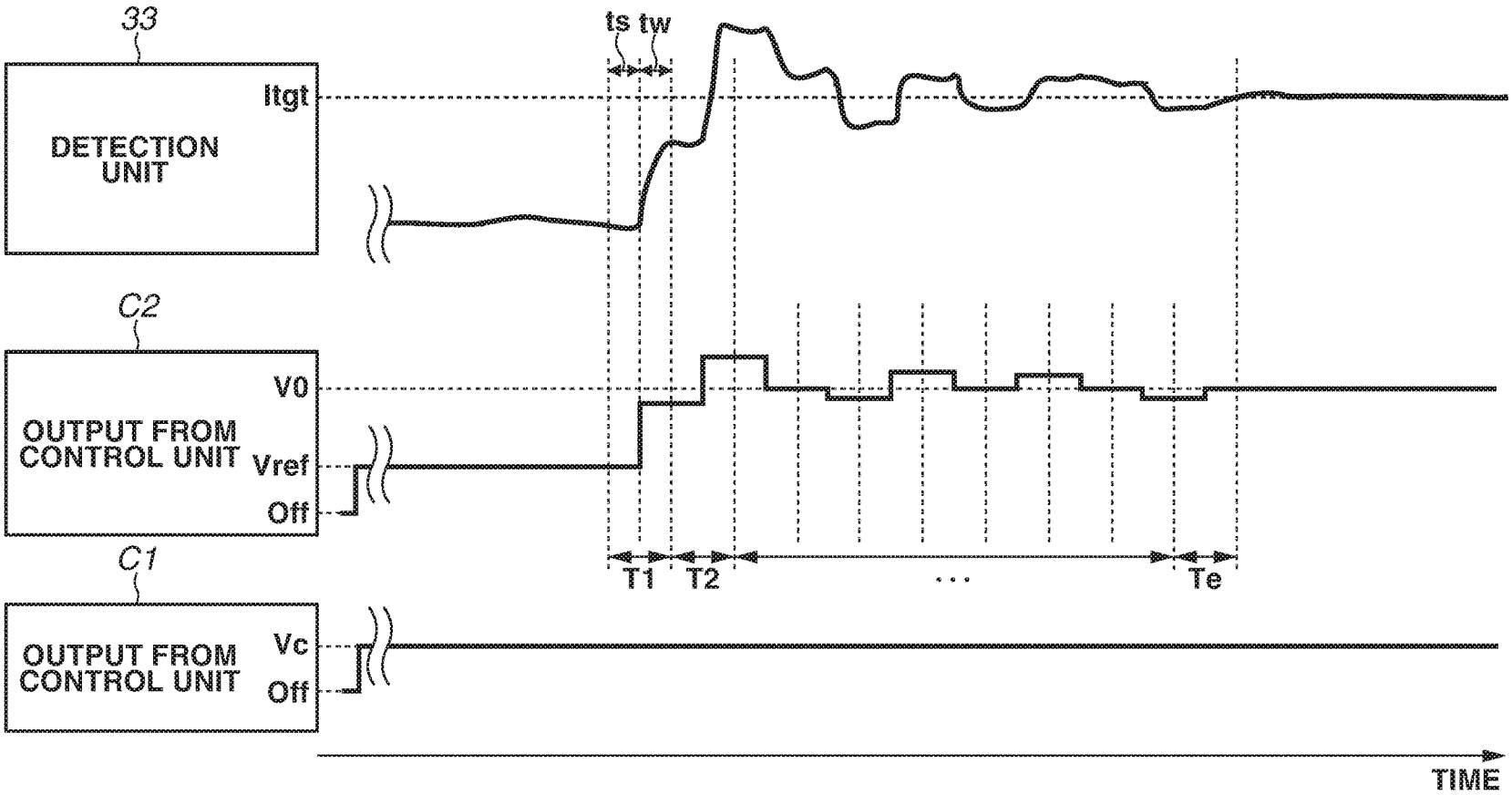
FIG. 3 is a time chart illustrating regulation control of a transfer voltage.
Figure 4:
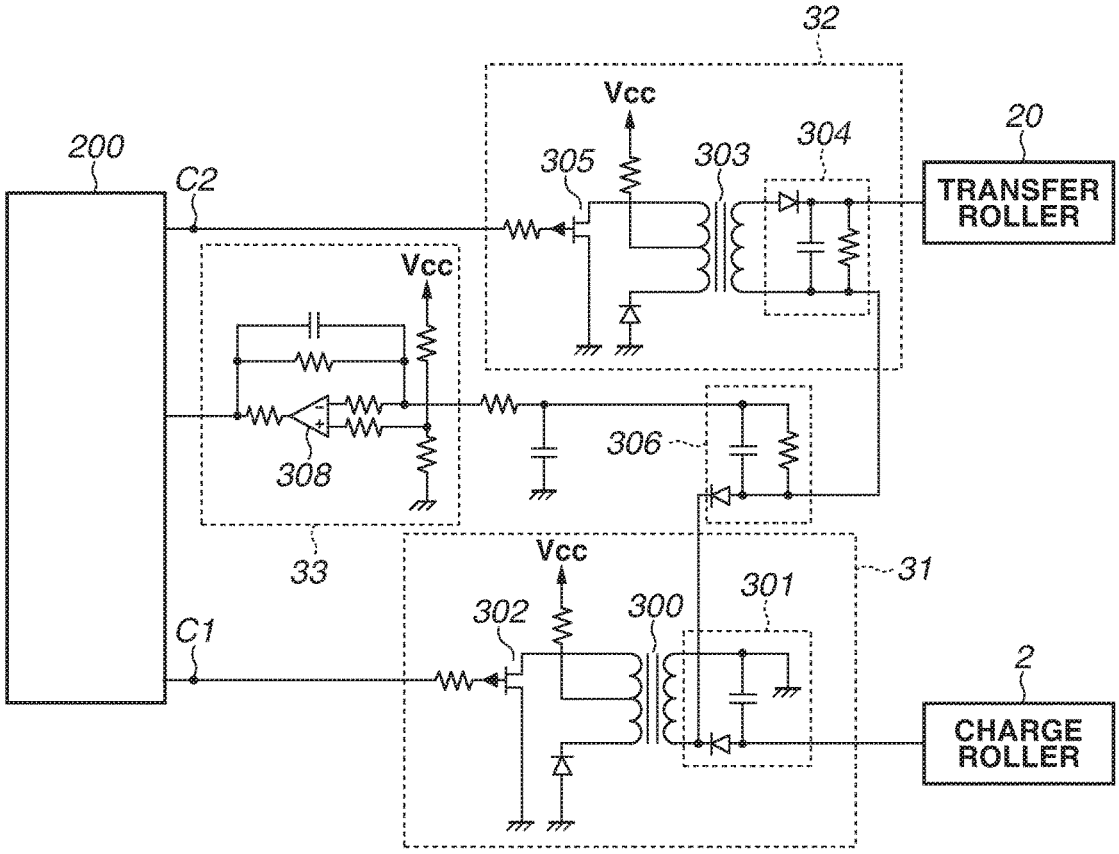
FIG. 4 is a schematic circuit structure diagram according to the first exemplary embodiment.

Next, ATVC as regulation control for setting a transfer voltage is described with reference to FIG. 3. FIG. 3 is a time chart illustrating voltage values output from the control unit 200 to the voltage output unit 31 and the voltage output unit 32 and an electric current value detected by a detection unit 33 for detecting an electric current flowing through the transfer roller 20 when the ATVC is executed. FIG. 4 is a circuit structure diagram illustrating configurations of the voltage output unit 31, the voltage output unit 32, and the detection unit 33 according to the present exemplary embodiment. The output from control unit 200, illustrated in the FIG. 3, is the voltage value at the position C1 and the position C2 illustrated in the FIG. 4.

When the ATVC is executed, first, the control unit 200 controls the voltage output unit 32 to output an initial voltage $V_{ref}$ to the transfer roller 20 and waits until the output of the initial voltage $V_{ref}$ is stabilized. Subsequently, as illustrated in FIG. 3, a result detected by the detection unit 33 is sampled for a time $t_s$, and a simple average current value $Ia_1$ is calculated from an electric current value measured in the time $t_s$. At that time, the voltage output unit 31 outputs a predetermined voltage Vc to the charge roller 2. Further, the control unit 200 calculates a voltage $V_{n+1}$ to be output from the voltage output unit 32 to the transfer roller 20 following the voltage $V_n$ using an equation 1 from a voltage $V_n$ output from the voltage output unit 32, a simple average current value $Ia_n$, and a target current value It in the ATVC.

[Equation 1]

$$V_{n+1}[V] = V_n\left(\alpha\left(\frac{I\ t[\mu A]}{I\ a_n[\mu A]} - 1\right) + 1\right) \quad (1)$$

In the equation 1, α is a control gain and stored in the control unit 200 as a predetermined desired constant value. The control unit 200 controls the voltage output unit 32, and the thus calculated voltage $V_{n+1}$ is output to the transfer roller 20. When the voltage output unit 32 outputs the voltage $V_{n+1}$, as illustrated in FIG. 3, an electric current value is sampled again for a predetermined time (the time $t_s$) after a standby time of a time $t_w$, and a voltage to be output following the voltage $V_{n+1}$ is calculated based on the equation 1. An upper limit value may be set to a change voltage value so that the voltage $V_{n+1}$ will not be an extremely large value in the equation 1.

The above-described three processes, namely the sampling of the electric current value detected by the detection unit 33, the calculation of the voltage $V_{n+1}$ using the equation 1, and the standby process after switching the voltage output from the voltage output unit 32 are counted as one time, and these predetermined processes are executed "e" times. The number of execution times "e" is a value preliminarily stored in the control unit 200 based on characteristics of the transfer roller 20 and the like and is defined as a predetermined number of execution times necessary for converging an electric current value on a minimum voltage region which can guarantee image quality and calculating a reference voltage V0. In other words, in the ATVC according to the present exemplary embodiment, the above-described three processes are repeated "e" times, and thus the electric current value flowing through the transfer roller 20 is converged on the target current value It. Further, a voltage output from the voltage output unit 32 when the above-described three processes are executed "e" times is regarded as the reference voltage V0, and the control unit 200 sets the transfer voltage based on a look-up table (LUT) preliminarily stored in a built-in memory and the reference voltage V0.

As illustrated in FIG. 4, the voltage output unit 31 includes a step-up transformer 300, a drive circuit 302 constituted of a switching element such as a field effect transistor (FET) for driving the step-up transformer 300 by a control signal from the control unit 200, and a rectifier circuit 301. A voltage having a negative polarity generated by the step-up transformer 300 is output via the rectifier circuit 301, and thus the voltage having the negative polarity can be output to the charge roller 2 and the transfer roller 20.

The voltage output unit 32 includes a step-up transformer 303, a drive circuit 305 constituted of a switching element such as an FET for driving the step-up transformer 303 by a control signal from the control unit 200, and a rectifier circuit 304. A voltage having a positive polarity generated by the step-up transformer 303 is output via the rectifier circuit 304, and thus the voltage having the positive polarity can be output to the transfer roller 20.

The voltage output unit 31 and the voltage output unit 32 are electrically connected to each other, and a rectifier circuit 306 superimposes the voltage having the negative polarity generated by the step-up transformer 300 on the voltage having the positive polarity generated by the step-up transformer 303. When an image is formed, it is necessary to output a voltage having a negative polarity to the charge roller 2 to form a toner image on the photosensitive drum 1 and output a voltage having a positive polarity to the transfer roller 20 to transfer the toner image formed on the photosensitive drum 1 to the transfer material P. According to the present exemplary embodiment, the voltage output unit 31 outputs the voltage having the negative polarity to the charge roller 2 and the transfer roller 20, so that when the voltage output unit 31 outputs the voltage having the negative polarity to the charge roller 2, the voltage having the negative polarity is also output to the transfer roller 20. Thus, when an image is formed, a voltage obtained by superimposing the voltage having the negative polarity output from the voltage output unit 31 on the voltage having the positive polarity output from the voltage output unit 32 is output to the transfer roller 20.

The detection unit 33 detects a superimposed electric current flowing through the rectifier circuit 306, converts the detected electric current value into a voltage value by an operational amplifier 308, and outputs the voltage value to the control unit 200. The voltage value is further converted into a corresponding electric current value by the control unit 200. As described above, the detection unit 33 detects the superimposed electric current flowing through the rectifier circuit 306 and thus may be affected when the voltage value output from the voltage output unit 31 is changed depending on a resistance constant of the circuit. In this case, when the voltage value output from the voltage output unit 31 to the charge roller 2 is changed in a state in which the voltage output unit 31 and the voltage output unit 32 output the voltages having respective polarities, the electric current value detected by the detection unit 33 may fluctuate.

In order to appropriately set the transfer voltage for forming an image by the ATVC, it is necessary to form a uniform potential on the photosensitive drum 1 by applying a voltage to the charge roller 2 based on setting information about an image to be formed when the ATVC is executed. However, in the configuration in which the pre-start is executed as the present exemplary embodiment, conversion of the image signal by the image controller 201 is not completed at the time of starting the ATVC, and the conveyance speed information for conveying the transfer material P and the setting information about the image formed on the transfer material P may not be fixed yet in some cases. In this case, the control unit 200 outputs a predetermined voltage from the voltage output unit 31 to the charge roller 2 and executes the ATVC in the configuration according to the present exemplary embodiment. Subsequently, the control unit 200 changes the voltage value output from the voltage output unit 31 to the charge roller 2 if necessary based on information from the image controller 201 which completes conversion of the image signal.

In the pre-start according to the present exemplary embodiment, a pre-rotation operation including driving starts of various units is performed in addition to the ATVC, and thus conversion of the image signal by the image controller 201 may be completed at the start time of the ATVC in some cases. In this case, the control unit 200 outputs a voltage corresponding to information from the image controller 201 which completes the conversion of the image signal from the voltage output unit 31 to the charge roller 2 and executes the ATVC.

Figure 5:
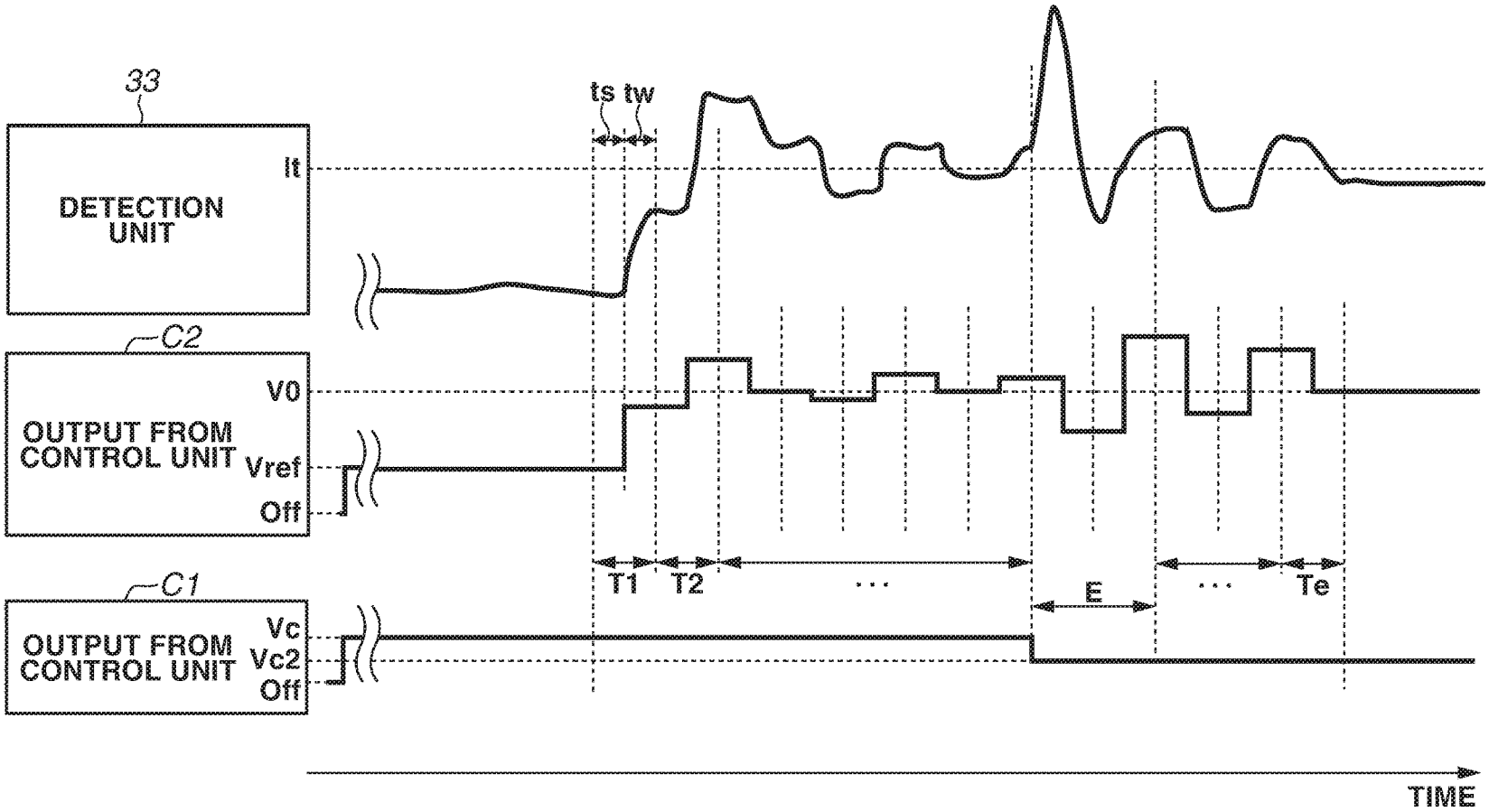
FIG. 5 is a time chart illustrating a fluctuation of an electric current detected by a detection unit when a voltage value output from a first voltage unit is changed while regulation control of a transfer voltage is executed.

FIG. 5 is a time chart illustrating an electric current value detected by the detection unit 33 when a voltage value output from the voltage output unit 31 to the charge roller 2 is changed according to the information from the image controller 201 which completes the conversion of the image signal during execution of the ATVC. As illustrated in FIG. 5, when the voltage value output from the voltage output unit 31 to the charge roller 2 is changed from the voltage Vc to a voltage Vc2, the electric current value detected by the detection unit 33 fluctuates in a predetermined time period E including the point of time when the voltage value is changed. The voltage Vc is a predetermined voltage (a first voltage) preliminarily stored in the control unit 200, and the voltage Vc2 is a voltage (a second voltage) set according to the information from the image controller 201 which completes the conversion of the image signal.

The electric current detected by the detection unit 33 is fed back to the voltage output from the voltage output unit 32 based on the equation 1. In other words, when the electric current detected by the detection unit 33 fluctuates, the output of the voltage output unit 32 being converged may diverge and cannot converge on the target current value It if the predetermined operations of the ATVC are repeated for the predetermined number of execution times ("e" times).

Accordingly, the transfer voltage value set by the ATVC may be deviated from the desired value, and transfer failure may occur when the toner image is transferred to the transfer material P at the transfer portion Nt. A timing when the conveyance speed information for conveying the transfer material P and the setting information about the image formed on the transfer material P are fixed depends on a processing capability of the image controller 201. In other words, the control unit 200 is required to consider a possibility to switch the voltage output from the voltage output unit 31 to the charge roller 2 at an arbitrary timing.

When the ATVC is started after the conveyance speed information for conveying the transfer material P and the setting information about the image formed on the transfer material P are fixed without using the pre-start, it is not necessary to switch the voltage output from the voltage output unit 31 to the charge roller 2 during execution of the ATVC. In this case, the transfer voltage value set by the ATVC can be suppressed from being deviated from the desired value, however, the ATVC is not started until the image controller 201 completes the conversion of the image signal. In other words, as compared to a case in which the pre-start is executed, a first print out time (FPOT) which is a time from when the control unit 200 receives an operation start signal to when the image forming operation is completed is elongated.

Figure 6:
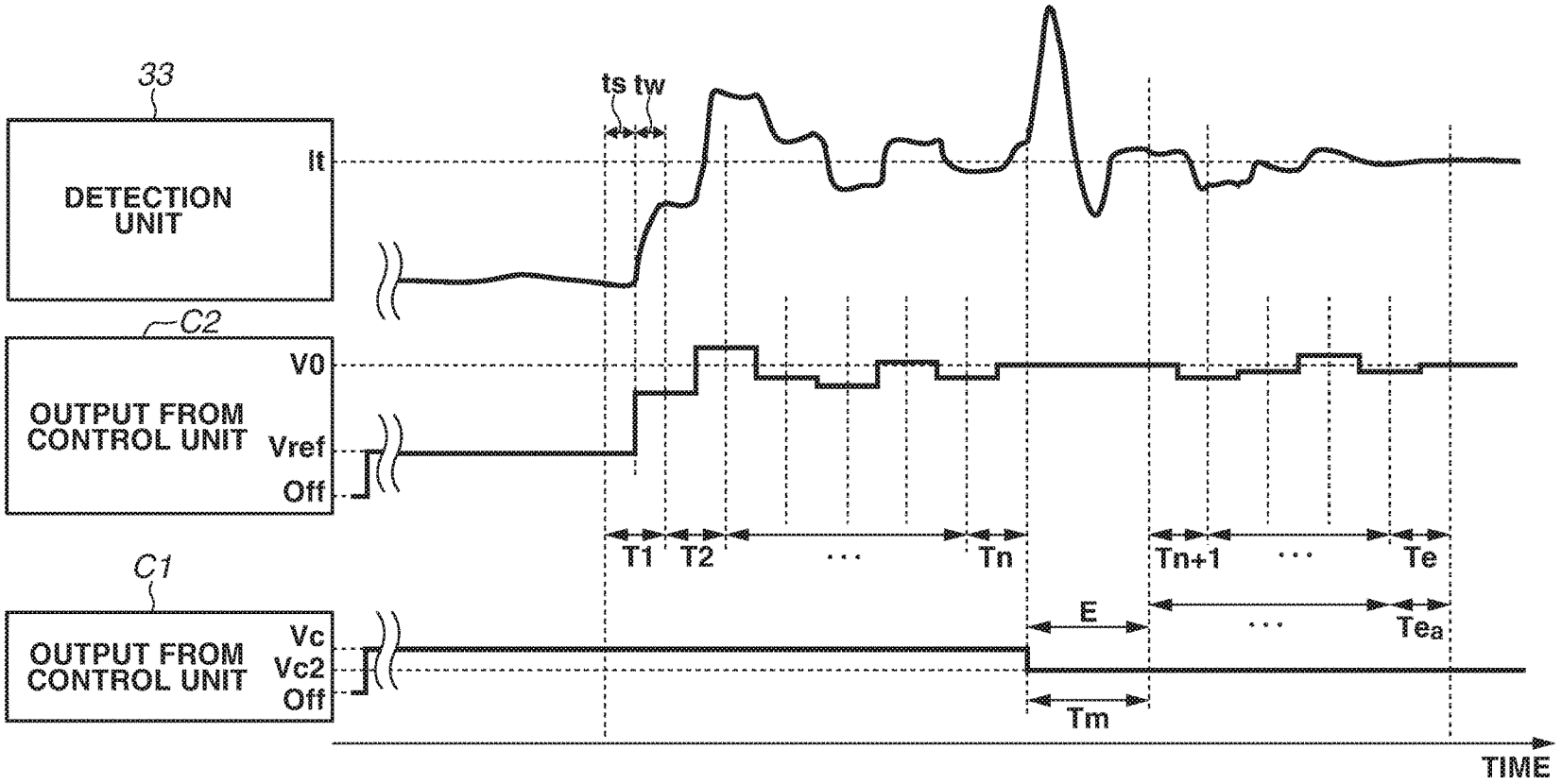
FIG. 6 is a time chart illustrating control when a voltage value output from the first voltage unit is changed while the regulation control of the transfer voltage is executed according to the first exemplary embodiment.

FIG. 6 is a time chart illustrating an electric current value detected by the detection unit 33 when a voltage value output from the voltage output unit 31 to the charge roller 2 is changed during execution of the ATVC in the control according to the present exemplary embodiment. As illustrated in FIG. 6, according to the present exemplary embodiment, the electric current value detected by the detection unit 33 in the predetermined time period E including the point of time when the voltage value output from the voltage output unit 31 is changed is not reflected to the ATVC.

More specifically, in the predetermined time period E, the voltage value output from the control unit 200 to the voltage output unit 32 is not changed, and the voltage value output from the control unit 200 to the voltage output unit 32 immediately before the voltage output from the voltage output unit 31 is switched from the voltage Vc to the voltage Vc2 is maintained. In other words, the predetermined operations based on the equation 1 are temporarily interrupted in the predetermined time period E. The predetermined time period E is a time period required for converging fluctuation of the electric current value detected by the detection unit 33 due to switching of the voltage output from the voltage output unit 31.

According to the present exemplary embodiment, a time Tm corresponding to the predetermined time period E is preliminarily stored in the control unit 200. The time Tm can be appropriately set according to the configuration of the image forming apparatus 100 by preliminarily measuring a time required for an electric current detected by the detection unit 33 to converge by switching the voltage output from the control unit 200 to the voltage output unit 31. More specifically, in the configuration of the image forming apparatus 100 according to the present exemplary embodiment, the predetermined time period E is set to a range from 0 to 170 milliseconds from a timing when the voltage output from the control unit 200 to the voltage output unit 31 is switched. In other words, according to the present exemplary embodiment, the time Tm corresponding to the predetermined time period E is 170 milliseconds.

According to the present exemplary embodiment, the voltage value output from the voltage output unit 31 is switched from the voltage Vc to the voltage Vc2 in synchronization with a finishing timing of the standby process after switching the voltage output from the voltage output unit 32, namely a finishing timing of a time Tn. However, a switching timing of the voltage output from the voltage output unit 31 is not limited to this. For example, the switching timing may be synchronized with a timing when sampling of the electric current value detected by the detection unit 33 is finished, and the voltage output from the voltage output unit 32 is switched based on the equation 1, or the voltage may be switched during sampling of the electric current value detected by the detection unit 33.

Further, after a lapse of the time Tm, the predetermined operations including the three processes namely the sampling of the electric current value detected by the detection unit 33, the calculation of the voltage $V_{n+1}$ using the equation 1, and the standby process after switching the voltage output from the voltage output unit 32 are executed again, and the ATVC is resumed. After resuming the ATVC, the number of execution times of the predetermined operations immediately after the predetermined time period E is regarded as the number of execution times "n+1" with respect to the number of execution times "n" of the predetermined operations immediately before the predetermined time period E, and the predetermined operations are executed until the predetermined number of execution times "e" is reached.

According to the present exemplary embodiment, when the number of execution times of the predetermined operations of the ATVC reaches the predetermined "e" times, and the number of execution times of the predetermined operations after resuming the ATVC reaches "$e_a$" times, it is determined that the electric current value is converged on the target current value It, and the reference voltage V0 is determined. Regarding the number of execution times "$e_a$" after resuming the ATVC, a predetermined value is stored in the control unit 200. The number of execution times "$e_a$" is prepared to secure a time necessary for determining the reference voltage V0 when executing the ATVC in consideration of an influence of a change in the voltage having the negative polarity output to the transfer roller 20 caused by switching the voltage output from the voltage output unit 31.

As described above, according to the present exemplary embodiment, execution of the predetermined operations of the ATVC is interrupted in the predetermined time period E when the voltage value output from the voltage output unit 31 is changed during execution of the ATVC. Further, the ATVC is resumed again after a lapse of the time Tm corresponding to the predetermined time period E, and the transfer voltage is set based on results before and after the predetermined time period E. Accordingly, the transfer voltage can be appropriately set by the ATVC, and transfer failure can be suppressed from occurring. Further, for example, an effect on the FPOT can be reduced compared to the configuration in which the ATVC is executed again when the voltage output to the charge roller 2 is changed during execution of the ATVC.

According to the present exemplary embodiment, the case is described in which the predetermined voltage Vc output from the voltage output unit 31 is different from the voltage Vc2 set according to the information from the image controller 201 after completion of conversion of the image signal. However, for example, when the voltage Vc and the voltage Vc2 have the same value, there is no need to switch the voltage output from the voltage output unit 31 to the charge roller 2, and thus the ATVC executed by then may be continued without setting the predetermined time period E.

According to the present exemplary embodiment, the control to continue the ATVC is described when the voltage value output from the voltage output unit 31 is changed during execution of the ATVC in the ATVC at the time of the pre-start. However, the control according to the present exemplary embodiment is executed when the voltage value output from the voltage output unit 31 is changed during execution of the ATVC without limiting to the time of the pre-start, and thus an effect similar to that according to the present exemplary embodiment can be obtained. For example, when a plurality of transfer materials P is conveyed, and the ATVC is executed between a previous transfer material P and a subsequent transfer material P, the control unit 200 may change the voltage value output from the voltage output unit 31 in some cases according to information of the transfer material P from the image controller 201.

Further, according to the present exemplary embodiment, the configuration is described in which the image controller 201 converts an image signal into video data and notifies the control unit 200 of various information pieces, and the control unit 200 controls various units. However, a single control unit may convert an image signal from the personal computer 101 as the host device into video data and controls various units based on various information pieces from the personal computer 101 without being limited to the above-described configuration.

According to the present exemplary embodiment, the charge roller 2 which abuts on and uniformly charges the photosensitive drum 1 is used as the charging member, however, a non-contact type charging member such as a charger using corona discharge may be used without being limited to the above-described configuration.

According to the first exemplary embodiment, the configuration is described in which the predetermined time period E is provided, and the predetermined operations of the ATVC are performed until the predetermined number of execution times "e" is reached when the voltage value output from the voltage output unit 31 is changed during execution of the ATVC. In contrast, according to a second exemplary embodiment, a configuration is described in which conveyance of a transfer material P is started after the predetermined operations of the ATVC are performed until the predetermined number of execution times "e" is reached, and the predetermined operations of the ATVC are continued until the detection sensor 7 detects a leading edge of the transfer material P. In the following descriptions, portions in common with the first exemplary embodiment are denoted by the same reference numerals, and the descriptions thereof are omitted.

Figure 7:
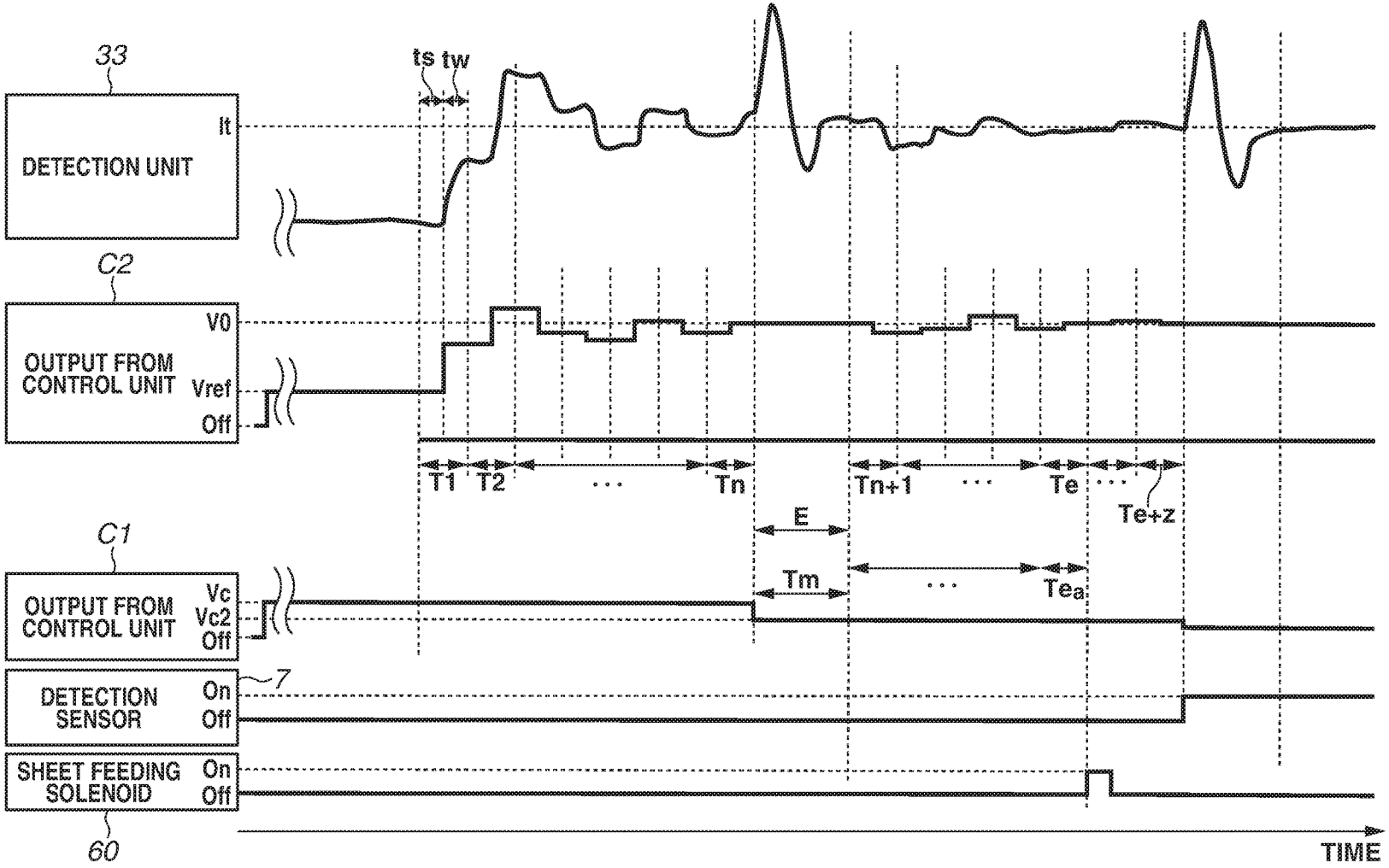
FIG. 7 is a time chart illustrating control when a voltage value output from a first voltage unit is changed while regulation control of a transfer voltage is executed according to a second exemplary embodiment.

FIG. 7 is a time chart illustrating an electric current value detected by the detection unit 33 when a voltage value output from the voltage output unit 31 to the charge roller 2 is changed during execution of the ATVC in the control according to the present exemplary embodiment. As illustrated in FIG. 7, the control up to a time Te is similar to that according to the first exemplary embodiment, so that the description thereof is omitted, and the control after the time Te is described in detail.

As illustrated in FIG. 7, when the number of execution times of the predetermined operations of the ATVC reaches the number of execution times "e", and the number of execution times of the predetermined operations of the ATVC after a lapse of the time Tm corresponding to the predetermined time period E reaches the number of execution times "$e_a$", the control unit 200 drives the sheet feeding solenoid 60. When the transfer material P is conveyed, and the detection sensor 7 detects a leading edge of the transfer material P, the control unit 200 controls the voltage output unit 31 and switches the voltage value output to the charge roller 2 to a target voltage value when forming an image. Subsequently, the control unit 200 switches the voltage value output from the voltage output unit 32 to the transfer roller 20 to the transfer voltage set by the ATVC at a timing (not illustrated) when the transfer material P is pinched by the transfer portion Nt based on a detection result of the detection sensor 7.

A timing when the detection sensor 7 detects the leading edge of the transfer material P differs depending on a storage condition and a type of the transfer material P stored in the sheet feeding cassette 9 and the like. For example, if the transfer material P slips when being fed by the feeding roller 4 to the conveyance roller 6, the leading edge detection of the transfer material P by the detection sensor 7 is delayed compared to the case when the transfer material P does not slip.

Thus, according to the present exemplary embodiment, the predetermined operations of the ATVC are repeatedly performed until the detection sensor 7 detects the leading edge of the transfer material P, in other words, until the voltage value output from the voltage output unit 31 to the charge roller 2 is switched as illustrated in FIG. 7. Accordingly, the predetermined operations of the ATVC can be executed for the number of execution times "e+z" which is greater than or equal to the predetermined number of execution times "e" necessary for converging the electric current value on a minimum voltage region which can guarantee image quality, and the reference voltage V0 can be accurately calculated.

As described above, according to the present exemplary embodiment, the predetermined operations of the ATVC are executed until the detection sensor 7 detects the transfer material P, and thus the transfer voltage can be more appropriately set by determining the reference voltage V0 more accurately in addition to the effect of the first exemplary embodiment.

According to the first and the second exemplary embodiments, execution of the ATVC in the configuration is described in which the voltage output unit 31 outputs the voltage having the negative polarity to the charge roller 2, and the voltage obtained by superimposing the voltages having the respective polarities output from the voltage output unit 31 and the voltage output unit 32 on one another is output to the transfer roller 20. According to a third exemplary embodiment, execution of the ATVC in a configuration which includes a feedback circuit 80 for stably controlling the voltage output from the voltage output unit 31 to the charge roller 2 with respect to the configuration according to the second exemplary embodiment is described with reference to FIGS. 8 and 9. In the following descriptions, portions in common with the first and the second exemplary embodiments are denoted by the same reference numerals, and the descriptions thereof are omitted.

Figure 8:
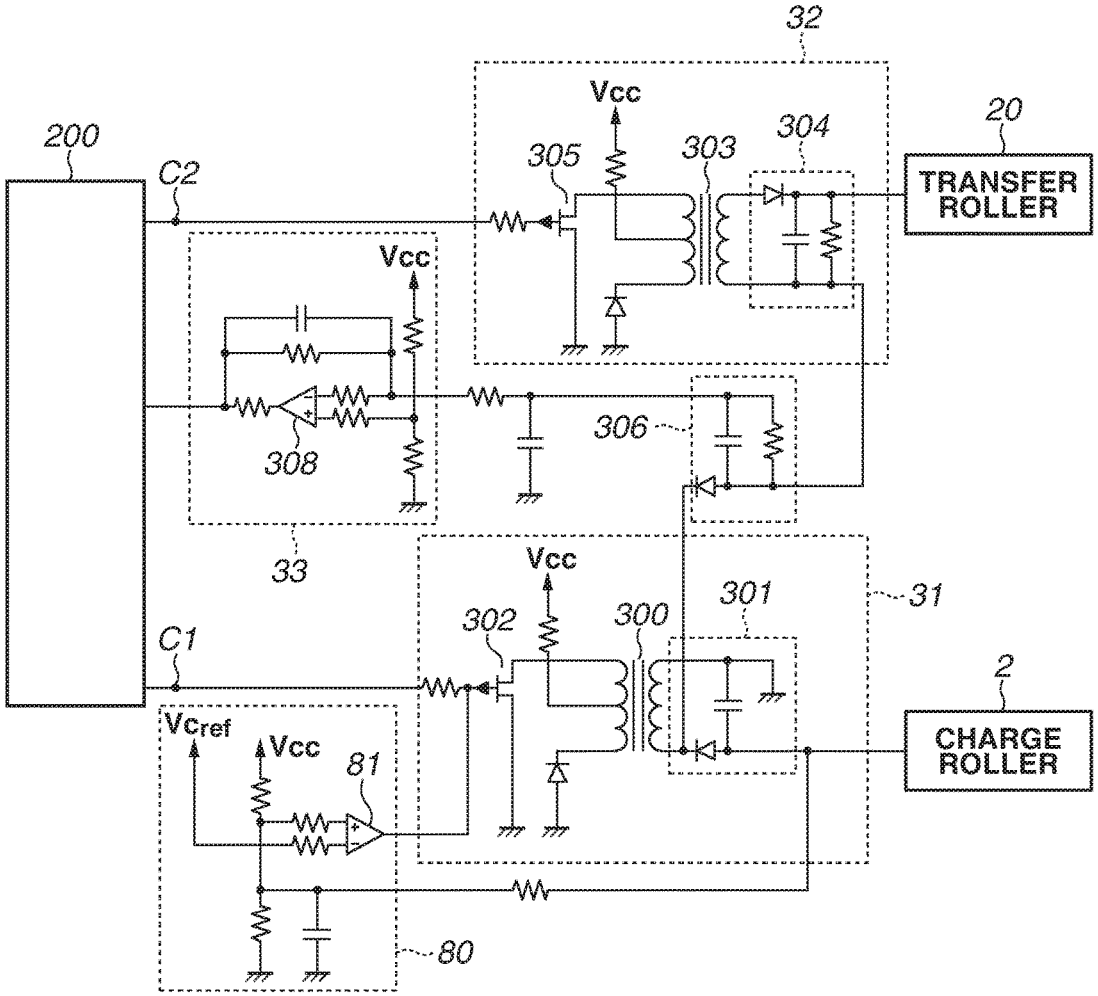
FIG. 8 is a schematic circuit structure diagram according to a third exemplary embodiment.
Figure 9:
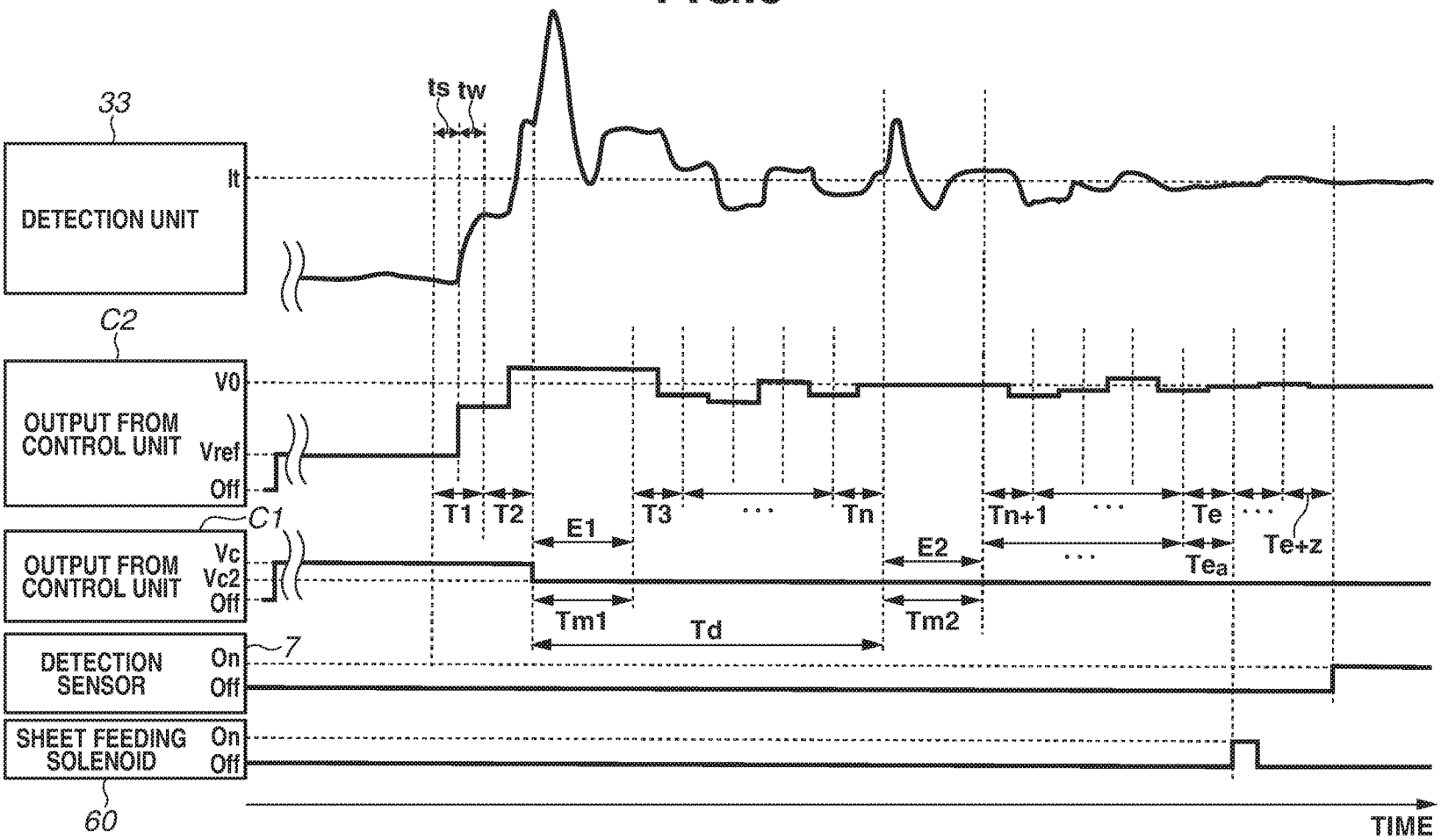
FIG. 9 is a time chart illustrating control when a voltage value output from a first voltage unit is changed while regulation control of a transfer voltage is executed according to the third exemplary embodiment.

FIG. 8 is a circuit structure diagram illustrating configurations of the voltage output unit 31, the voltage output unit 32, the detection unit 33, and the feedback circuit 80 according to the present exemplary embodiment. The feedback circuit 80 is a control circuit for stably controlling the voltage output from the voltage output unit 31 to the charge roller 2. More specifically, the feedback circuit 80 compares a voltage obtained by dividing a voltage rectified by the rectifier circuit 301 by two resistors to a reference voltage $Vc_{ref}$ by an operational amplifier 81 and performs control so that the voltage output to the charge roller 2 is maintained constant. FIG. 9 is a time chart illustrating an electric current value detected by the detection unit 33 when a voltage value output from the voltage output unit 31 to the charge roller 2 is changed during execution of the ATVC in the control according to the present exemplary embodiment.

The voltage output from the voltage output unit 31 to the charge roller 2 is affected by a surface potential of the photosensitive drum 1. When the control unit 200 performs control to change the voltage output from the voltage output unit 31 to the charge roller 2, the surface potential of the photosensitive drum 1 is changed, and a change point of the surface potential reaches a position at which the charge roller 2 is in contact with the photosensitive drum 1 after one rotation of the photosensitive drum 1. At that time, the feedback circuit 80 applies feedback, and an electric current value flowing through the rectifier circuit 301 is changed in a short term because of an influence of the feedback by the feedback circuit 80. Thus, as illustrated in FIG. 9, the electric current detected by the detection unit 33 fluctuates during a predetermined time period E2.

A configuration according to the present exemplary embodiment is described below using an example in which the voltage output from the voltage output unit 31 to the charge roller 2 is switched after executing the predetermined operations of the ATVC twice and a lapse of a time $T_s$ as illustrated in FIG. 9. First, in a predetermined time period E1 including a point of time when the voltage output from the voltage output unit 31 is switched, the execution of the predetermined operations of the ATVC is interrupted, and after a lapse of a time Tm1 corresponding to the predetermined time period E1, the execution of the predetermined operations of the ATVC based on the equation 1 are resumed.

A time Td represents a time from a point of time when the voltage output from the voltage output unit 31 is switched, namely the start of the time Tm1 to when the photosensitive drum 1 rotates one turn. In the configuration according to the present exemplary embodiment, the electric current value detected by the detection unit 33 fluctuates in the predetermined time period E2 at a point of time when the time Td elapses from a point of time when the voltage output from the voltage output unit 31 is switched due to the influence of the feedback by the feedback circuit 80. Thus, according to the present exemplary embodiment, the execution of the predetermined operations of the ATVC is interrupted in the predetermined time period E2, and the execution of the predetermined operations of the ATVC based on the equation 1 is resumed after a lapse of a time Tm2 corresponding to the predetermined time period E2 as illustrated in FIG. 9.

According to the present exemplary embodiment, the time Tm1 and the time Tm2 respectively corresponding to the predetermined time period E1 and the predetermined time period E2 are preliminarily stored in the control unit 200. The time Tm1 and the time Tm2 can be appropriately set according to the configuration of the image forming apparatus 100 using the similar method for setting the time Tm according to the first and the second exemplary embodiments. More specifically, in the configuration of the image forming apparatus 100 according to the present exemplary embodiment, the predetermined time period E1 is set to a range from 0 to 170 milliseconds from a timing when the voltage output from the control unit 200 to the voltage output unit 31 is switched. Further, the predetermined time period E2 is set to a range from 615 to 735 milliseconds from a timing when the voltage output from the control unit 200 to the voltage output unit 31 is switched. In other words, according to the present exemplary embodiment, the time Tm1 is 170 milliseconds, and the time Tm2 is 120 milliseconds.

The control unit 200 drives the sheet feeding solenoid 60 when the number of execution times of the predetermined operations of the ATVC reaches "e" times, and the number of times of the predetermined operations of the ATVC executed after the lapse of the time Tm2 reaches "$e_a$" times. Subsequently, the control unit 200 continues the execution of the predetermined operations of the ATVC until the detection sensor 7 detects the leading edge of the transfer material P and determines the reference voltage V0. According to the present exemplary embodiment, the number of execution times "e" and the number of execution times "$e_a$" are preliminarily stored in the control unit 200 as with the first and the second exemplary embodiments.

According to the present exemplary embodiment, the configuration is described in which the predetermined operations of the ATVC are continued until the detection sensor 7 detects the leading edge of the transfer material P as with the second exemplary embodiment, however, the present exemplary embodiment is not limited to this configuration. The present exemplary embodiment may adopt a configuration in which when the number of execution times of the predetermined operations of the ATVC reaches "e" times, and the number of execution times of the predetermined operations after the lapse of the time Tm2 reaches "$e_a$" times, it is determined that the electric current value is converged on the target current value It, and the reference voltage V0 is determined as with the first exemplary embodiment.

The present exemplary embodiment describes the control when a rotation speed of the photosensitive drum 1 is not variable, however, may adopt a configuration in which the rotation speed of the photosensitive drum 1 is variable, and the rotation speed of the photosensitive drum 1 can be changed by designation from the image controller 201. The time Td in FIG. 9 is determined from the rotation speed and a diameter of the photosensitive drum 1. Thus, when the voltage output from the voltage output unit 31 is changed in the configuration in which the rotation speed of the photosensitive drum 1 is variable, the time Td can be shortened in some cases by switching the rotation speed of the photosensitive drum 1 to a faster speed.

As described above, the configuration provided with the feedback circuit 80 according to the present exemplary embodiment can obtain an effect similar to that according to the first and the second exemplary embodiments by interrupting execution of the predetermined operations of the ATVC in the predetermined time period E1 and the predetermined time period E2.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Applications No. 2017-229299, filed Nov. 29, 2017, and No. 2018-198358, filed Oct. 22, 2018, which are hereby incorporated by reference herein in their entirety.

What is claimed is:

1. An image forming apparatus comprising:

a photosensitive member configured to bear a toner image;

a charging member configured to charge the photosensitive member;

a transfer member configured to form a transfer portion by abutting on the photosensitive member and to transfer the toner image borne by the photosensitive member to a transfer material at the transfer portion;

a first voltage unit configured to output a voltage having a predetermined polarity to the charging member and the transfer member;

a second voltage unit configured to be electrically connected to the first voltage unit and to output a voltage having an opposite polarity to that of the predetermined polarity output to the transfer member;

a detection unit configured to detect an electric current flowing through the transfer member; and a control unit configured to control the first voltage unit and the second voltage unit, wherein the control unit applies the voltage having the predetermined polarity to the charging member, applies a voltage obtained by superimposing the voltage having the predetermined polarity on the voltage having the opposite polarity to the transfer member, and performs regulation control to set a transfer voltage to be output from the second voltage unit to the transfer member, to transfer a toner image from the photosensitive member to a transfer material based on an electric current value detected by the detection unit and a voltage value output from the second voltage unit by causing the first voltage unit and the second voltage unit to respectively output voltages, in a state in which a transfer material is not nipped by the transfer portion, and wherein, in a case where the control unit changes a voltage value output from the first voltage unit while performing the regulation control, the control unit does not reflect a detection result detected by the detection unit to the regulation control during a predetermined time period including a point of time when the voltage output from the first voltage unit is changed.

2. The image forming apparatus according to claim 1, wherein, in a case where the control unit changes the voltage value output from the first voltage unit while performing the regulation control, the control unit sets the transfer voltage, based on an electric current value detected by the detection unit and a voltage value output from the second voltage unit, in time periods before and after the predetermined time period.

3. The image forming apparatus according to claim 1, wherein, in a case where the control unit executes the regulation control, the control unit switches a voltage output from the second voltage unit based on an electric current value detected by the detection unit so as to converge the electric current value detected by the detection unit on a predetermined target electric current value and sets the transfer voltage based on the voltage value output from the second voltage unit when the target electric current value is converged.

4. The image forming apparatus according to claim 3, wherein, in a case where the control unit executes the regulation control, the control unit repeatedly performs a predetermined operation for switching the voltage value output from the second voltage unit to the transfer member based on the electric current value detected by the detection unit after the voltage value output from the second voltage unit is stabilized so as to converge the electric current value detected by the detection unit to the target electric current value.

5. The image forming apparatus according to claim 4, wherein the control unit repeatedly performs the predetermined operation until a number of execution times of the predetermined operation in time periods before and after the predetermined time period reaches a predetermined first number of execution times and thus converges the electric current value detected by the detection unit to the target electric current value.

6. The image forming apparatus according to claim 5, wherein the control unit repeatedly executes the predetermined operation until the number of execution times of the predetermined operation in a time period after the predetermined time period reaches a predetermined second number of execution times and thus converges the electric current value detected by the detection unit to the target electric current value.

7. The image forming apparatus according to claim 6, further comprising:

a storage unit configured to store a transfer material; and a feeding unit configured to feed the transfer material from the storage unit to the transfer portion, wherein the control unit drives the feeding unit to feed the transfer material at a timing when the number of execution times of the predetermined operation, in the time periods before and after the predetermined time period, reaches the first number of execution times, and the number of execution times of the predetermined operation, in the time period after the predetermined time period, reaches the second number of execution times.

8. The image forming apparatus according to claim 7, further comprising a detection portion disposed between the transfer portion and the feeding unit in a conveyance direction of the transfer material and configured to detect the transfer material fed by the feeding unit to the transfer portion, wherein the control unit drives the feeding unit to feed the transfer material and then repeatedly executes the predetermined operation until the detection portion detects a leading edge of the transfer material in the conveyance direction the transfer material.

9. The image forming apparatus according to claim 3, wherein, in the predetermined time period, the control unit does not change the voltage value output from the second voltage unit and maintains the voltage value output from the second voltage unit immediately before the voltage value output from the first voltage unit is changed.

10. The image forming apparatus according to claim 4, further comprising a feedback circuit configured to control a voltage output from the first voltage unit to the charging member, wherein, in a case where the control unit changes the voltage value output from the first voltage unit while executing the regulation control, the control unit does not reflect, to the regulation control, a detection result detected by the detection unit in a first predetermined time period including a point of time when the voltage output from the first voltage unit is changed and in a second predetermined time period after a time for the photosensitive member to rotate one turn elapses from the point of time when the voltage output from the first voltage unit is changed.

11. The image forming apparatus according to claim 10, wherein the control unit repeatedly executes the predetermined operation until the number of execution times of the predetermined operation in a time period excluding the first predetermined time period and the second predetermined time period reaches a predetermined first number of execution times and thus converges the electric current value detected by the detection unit to the target electric current value.

12. The image forming apparatus according to claim 10, wherein the control unit repeatedly executes the predetermined operation until the number of execution times of the predetermined operation in a time period after the second predetermined time period reaches a predetermined second number of execution times and thus converges the electric current value detected by the detection unit to the target electric current value.

13. The image forming apparatus according to claim 12, further comprising:

a storage unit configured to store a transfer material; and a feeding unit configured to feed the transfer material from the storage unit to the transfer portion, wherein the control unit drives the feeding unit to feed the transfer material at a timing when the number of execution times of the predetermined operation in a time period excluding the first predetermined time period and the second predetermined time period reaches the first number of execution times, and the number of execution times of the predetermined operation in a time period after the second predetermined time period reaches the second number of execution times.

14. The image forming apparatus according to claim 13, further comprising a detection portion disposed between the transfer portion and the feeding unit in a conveyance direction of the transfer material and configured to detect the transfer material fed by the feeding unit to the transfer portion, wherein the control unit drives the feeding unit to feed the transfer material and then repeatedly executes the predetermined operation until the detection portion detects a leading edge of the transfer material in the conveyance direction the transfer material.

15. The image forming apparatus according to claim 10, wherein the control unit does not execute an operation for switching the voltage value output from the second voltage unit based on the electric current detected by the detection unit in the first predetermined time period and the second predetermined time period.

16. The image forming apparatus according to claim 1, wherein the control unit is capable of starting the regulation control by controlling the first voltage unit and the second voltage unit while an image signal transmitted to the control unit is converted into data for forming an image in the image forming apparatus.

17. The image forming apparatus according to claim 16, wherein, in a case where the control unit executes the regulation control, the control unit outputs a predetermined first voltage from the first voltage unit to the charging member.

18. The image forming apparatus according to claim 17, wherein the control unit starts the regulation control by outputting the first voltage from the first voltage unit to the charging member and changes the voltage value output from the first voltage unit from the first voltage based on the data after conversion of the data is completed.

19. The image forming apparatus according to claim 1, wherein, in a case where a toner image is transferred from the photosensitive member to a transfer material at the transfer portion, the control unit controls the first voltage unit and the second voltage unit to output a voltage obtained by superimposing the voltage having the predetermined polarity output from the first voltage unit to the charging member on the voltage having the opposite polarity output from the second voltage unit to the transfer member.

* * * * *